United States Patent [19]

Gottwald et al.

[11] 4,259,058

[45] Mar. 31, 1981

[54] BURNER APPARATUS USING VAPORIZED FUEL

[76] Inventors: Anthony Gottwald; Otto Gottwald, both of 50 Debussy La., Ventura, Calif. 93003

[21] Appl. No.: 64,874

[22] Filed: Aug. 8, 1979

[51] Int. Cl.[3] ..... F23D 11/44

[52] U.S. Cl. ..... 431/220; 431/239; 431/351; 431/218; 126/43

[58] Field of Search ..... 431/195, 196, 199, 201, 431/218, 220, 221, 239, 321, 351; 126/40, 43, 44; 239/424, 548, 567

[56] References Cited

U.S. PATENT DOCUMENTS

| | | | |
|---|---|---|---|
| 992,181 | 5/1911 | Foss | 431/351 |
| 1,063,067 | 5/1913 | Rochte | 431/220 |
| 1,447,295 | 3/1923 | Crisenberry | 431/201 |
| 1,495,929 | 5/1924 | Sherman | 431/201 |
| 2,335,020 | 11/1943 | Nehrich | 126/43 |
| 2,507,493 | 5/1950 | Bailey | 126/43 |
| 4,126,117 | 11/1978 | Hastings | 126/44 |

*Primary Examiner*—Samuel Scott
*Assistant Examiner*—Lee E. Barrett
*Attorney, Agent, or Firm*—Ralph B. Pastoriza

[57] ABSTRACT

A burner apparatus is specially designed for vaporized fuels such as alcohol vapor for use by campers, aboard small boats, in vans, and the like. Extremely efficient combustion is achieved by an annular air/fuel mixer plate with a plurality of circular openings facing upwardly positioned above an annular vapor generator member having an annular cavity with fuel outlet ports passing through the top wall of the cavity in positions spaced vertically below and in axial alignment with the circular openings in the air/fuel mixer plate, respectively. A liquid fuel line communicates with the interior portion of the cavity for introducing liquid fuel therein and once combustion has started, the fuel is vaporized to pass out the fuel openings. The vertical spacing between and vertical alignment of the mixer plate openings and vapor generator member outlet ports is such that fuel vapor passing upwardly through the ports draws air upwardly around the member into the space between the member and plate and up through the openings in the plate to mix with the fuel vapor and provide extremely efficient combustion flames after ignition has taken place.

14 Claims, 11 Drawing Figures

BURNER APPARATUS USING VAPORIZED FUEL

This application is based on Document Disclosure Registration Number 080997.

This invention relates generally to burners or portable stoves and more particularly to an improved portable type vaporized fuel burner preferably utilizing alcohol as the fuel.

BACKGROUND OF THE INVENTION

Most portable stoves or burners such as used on boats or in campers are operated with bottled gas under fairly high pressure or, alternatively, liquid fuel which normally requires some type of pressurization. Where bottled gas is employed, a fairly good supply must be kept on hand since the gas is fairly rapidly dissipated. The use of liquid fuel has advantages in that a large supply can be kept on hand in liquid form and then ultimately vaporized. In the latter type stove or burners utilizing liquid fuel, the fuel tank for the burner is normally provided with a built in manually operable pump in order to place the liquid fuel under pressure. The pressure is necessary in order to realize proper feeding and vaporization of the fuel to the burner. However, to manually pump these types of liquid fuel tanks is a nuisance and can become physically tiring.

BRIEF DESCRIPTION OF THE PRESENT INVENTION

With the foregoing in mind, the present invention contemplates a greatly improved burner apparatus using vaporized fuel such as alcohol wherein essentially no large pressurization is necessary. In fact, only sufficient pressure is required to move the fuel in a liquid fuel line to the burner itself.

The design of the burner is such as to realize very efficient combustion. As a consequence, maximum use is made of the fuel, preferably alcohol, to yield a given amount of heat.

Briefly, the apparatus includes at least one air/fuel mixer plate lying substantially in a horizontal plane having a plurality of circular openings facing upwardly. At least one vapor generator member defining an elongated cavity with a plurality of fuel vapor outlet ports passing through the top wall of the cavity, in turn, is positioned such that these ports are spaced vertically below and in axial alignment with the circular openings in the air/fuel mixer plate respectively. At least one liquid fuel line communicates with the interior portion of the cavity for introducing liquid fuel therein. The vertical spacing between and dimensioning of of the air/fuel mixer plate openings and vapor generator member outlet ports is such that fuel vapor passing upwardly through the ports draws air upwardly around the member into the space between the member and plate and up through the opening in the plate to mix with the fuel vapor and provide an efficiently combusting flame after complete ignition has taken place.

In preferred embodiments of the invention, additional air/fuel mixer plates and an additional vapor generator member are provided to improve the combustion efficiency and also provide a larger flame area for cooking purposes.

Further features of this invention include in combination with the burner, fuel storage means which is also portable and a simple but very accurate and easily operable regulator valve means for controlling fuel passed to the burner from the fuel storage means.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE INVENTION

Figure 1:
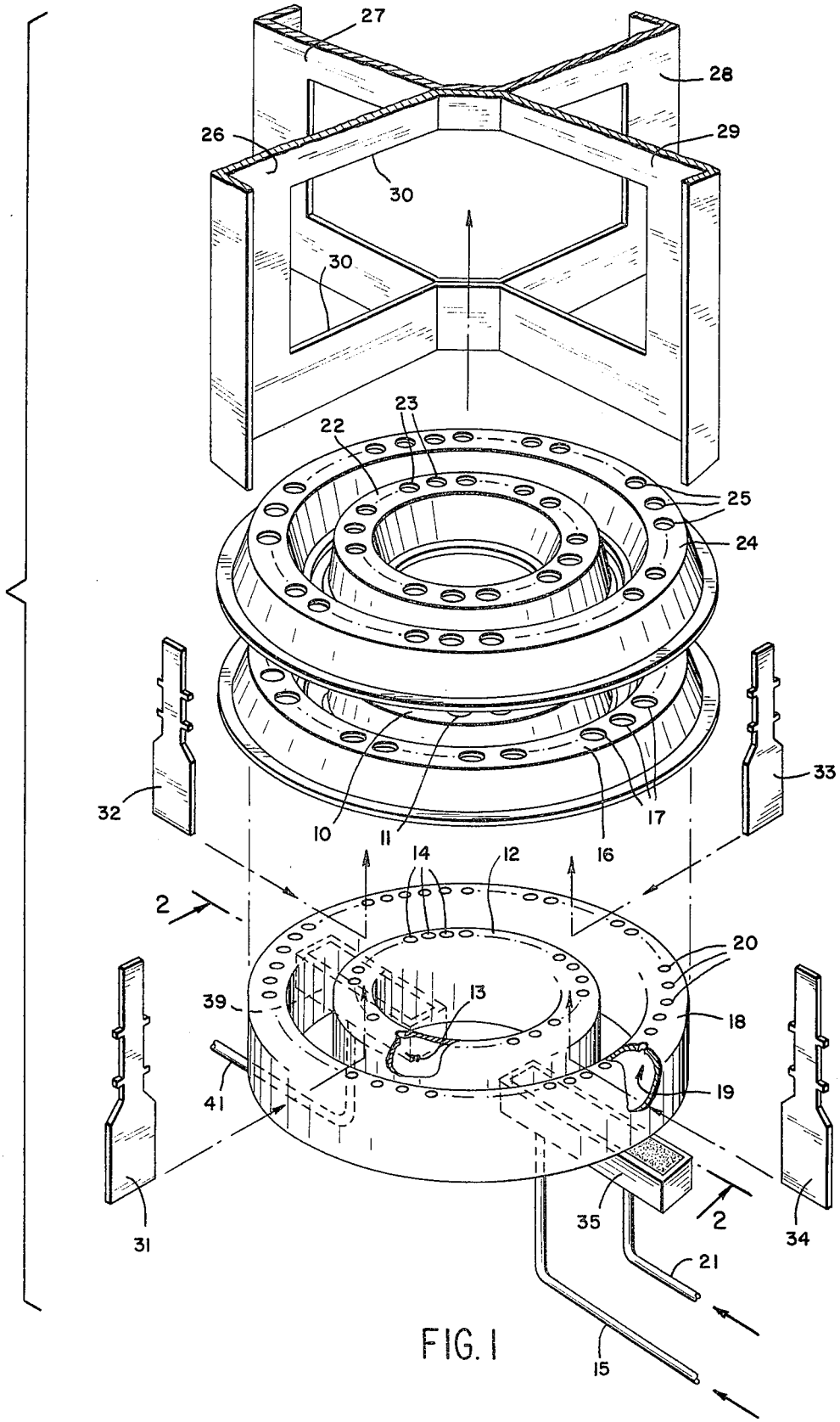
FIG. 1 is an exploded fragmentary perspective view of the basic components making up the burner apparatus of this invention.

Referring first to the exploded view of FIG. 1, there is shown in the central portion an inner air/fuel mixer plate 10 lying substantially in a horizontal plane generally of annular shape and having a plurality of circular openings such as indicated at 11 facing vertically upwardly.

Shown spaced vertically and below the inner annular plate 10 is an annular vapor generator member 12 defining an elongated cavity indicated by the arrow 13 in the broken away portion with fuel vapor outlet ports 14 passing through the top wall of the cavity. These outlet ports in the inner member 12 are in positions spaced vertically below and in axial alignment with the circular openings 11 in the inner air fuel mixer plate 10, as will become evident as the description proceeds. The annular cavity 13 of the inner annular vapor generator member 12 is provided with fuel through a first liquid fuel line indicated in the lower right portion of FIG. 1 at 15.

The elements described thus far constitute the minimum number of components making up this invention. Actually, in the preferred embodiment, there are provided additional components similar to those described. Thus, still referring to FIG. 1, in addition to the inner annular air/fuel mixer plate 10 there is provided an outer-annular air/fuel mixer plate 16 of larger diameter than the inner plate coplanar and coaxial with the inner plate as shown. This outer plate 16 has a plurality of circular openings 17 facing upwardly.

Similarly, there is provided in addition to the inner annular vapor generator member 12, an outer annular vapor generator member 18 of larger diameter than the inner member coplanar and coaxial with this inner member and provided with an internal annular cavity 19. This outer member has appropriate fuel ports 20 in the top wall of the annular cavity in vertically spaced axial alignment with the openings 17 in the outer air/fuel mixer plate 16.

An additional liquid fuel inlet line is shown in the lower right portion of FIG. 1 at 21 extending into communication with the annular cavity 19 of the outer vapor generator member 18.

The addition of the air/fuel outer mixer plate 16 and the vapor generator member 18 simply provides for more burning area to accommodate large diameter pans.

In addition to the outer plate and outer vapor generator member described, the preferred embodiment of this invention includes additional inner and outer air/fuel mixer plates shown above the initially described plates 10 and 16. These additional inner and outer mixer plates are indicated at 22 with upwardly facing openings 23 and at 24 with upwardly facing openings 25, respectively. The inner and outer plates 22 and 24 are identical in overall dimensions to the inner and outer air/fuel mixer plates 10 and 16, and, as shown, are axially spaced with their respective openings in axial alignment with the openings of the inner and outer plates 10 and 16.

The burner structure described in FIG. 1 is completed by the provision of a wind baffling structure in the form of crossed vertical vanes 26, 27, 28 and 29 with vertical cut-out portions indicated at 30 together with appropriate spacer means shown exploded outwardly and below the vanes as at 31, 32, 33 and 34. In the showing of FIG. 1, the vanes 26 through 29 extend vertically higher than illustrated, the top portion being cut off in order to be accommodated on the sheet of drawings.

Figure 2:
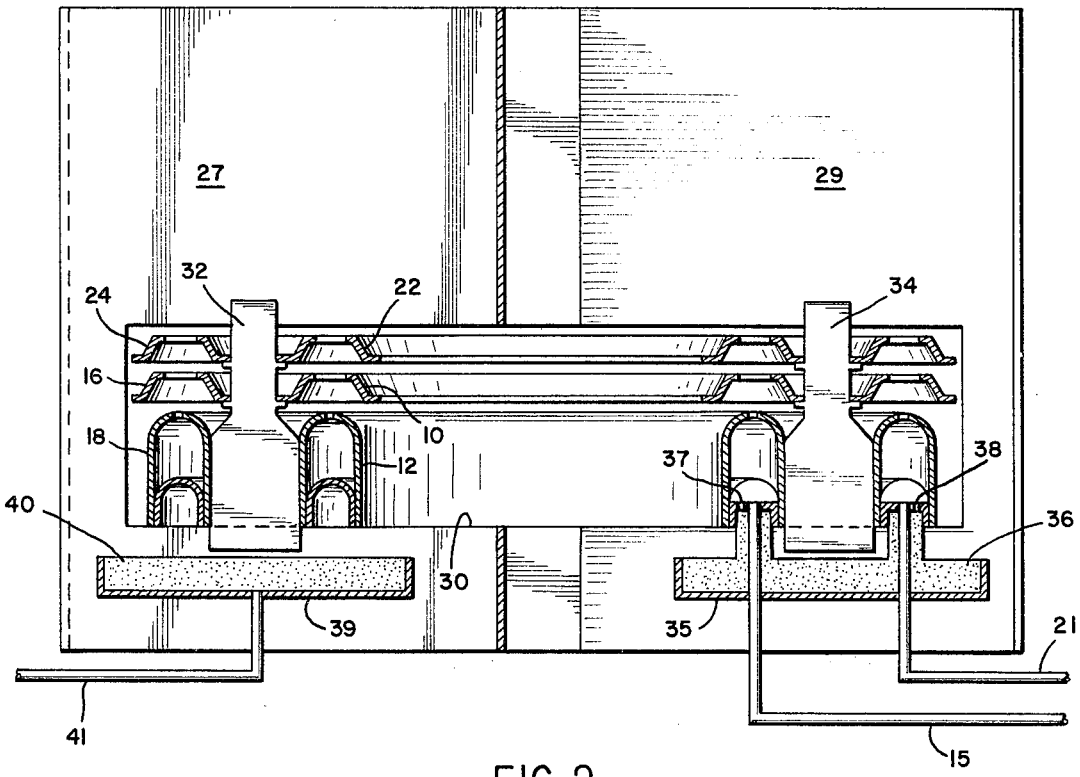
FIG. 2 is a cross section looking generally in the direction of the arrows 2—2 of FIG. 1 after the components have been assembled.

The vane structures together with the spacers 31 through 34 secure the air/fuel mixer plates and the vapor generator members in their vertically spaced axially aligned positions as will now be evident by referring to the assembled structure in FIG. 2 of the drawings.

In FIG. 2, the proportional height of the vanes such as the vanes 27 and 29 relative to the other components is evident. Further, it will be noted that the spacers such as the spacers 32 and 34 are designed to hold the plates and members in the desired vertical spaced and coaxial relationship, these spacers being inserted initially with their planes parallel to the exterior sides of the vapor generator members and thence twisted 90° so that the small lateral projections can fit under and support the plates in the illustrated relationship. The spacers themselves can then be welded or otherwise permanently affixed to the adjacent vane structures.

In the showing of FIG. 2, all of the component parts described with respect to FIG. 1 have been designated by the same numerals.

Referring specifically to the inner and outer air/fuel mixer plates, such as shown at 10 and 16 or 22 and 24, it will be clear that each plate is annular with a hat shaped cross section, the openings extending through the top of the annular shape and the side walls of the cross section diverging in a downward direction.

The vapor generator members, in turn, have convex top surfaces as viewed in cross section defining the top wall of their respective cavities so that the exterior sides of the cavities and rounded top walls cooperate with the diverging walls of the mixer plates to provide for efficient combustion, all as will become clearer as the description proceeds.

Still referring to FIG. 2, particularly the right hand portion thereof, there is shown a start trough 35 with a wick 36 disposed beneath the portions or the annular vapor generator members 12 and 18 receiving the liquid fuel lines 15 and 21 respectively. Referring specifically to the communication of these fuel lines with the cavities inside the members, it will be noted that the floor of the cavities are flattened at the entry points of the lines and that there are provided bottom wall openings such as at 37 and 38. Liquid fuel received in the lines 15 and 21 can overflow through the bottom openings into the wick in the trough. By then igniting the wick 36 in the trough, the flames will heat the annular members and vaporize further liquid fuel passing thereinto all around the annular cavities and also will ignite the fuel exiting from the upper fuel outlet ports of the members. The fuel entering through the lines 15 and 21 will thereafter be automatically vaporized by the heat after ignition has taken place, and there will be no further overflow into the wick 36 of the trough 35. Actually, the fuel in the wick 36 will simply burn out.

Referring to the left of FIG. 2, there is shown an alternative start arrangement which may be used in lieu of the trough 36 or in addition thereto. In the particular embodiment disclosed, the trough 39 is provided in addition to the trough 36.

The trough 39 includes a wick 40 and a start fuel inlet line 41. Initially, fuel is introduced into the wick 40 through the line 41 and the wick is ignited with a match. The heat from the wick will heat the annular members 12 and 18 and thus vaporize fuel passing thereinto through the inlet lines 15 and 21. The vaporized fuel will pass out through the top ports and thus be ignited by flames from the wick 40. When using this particular means of starting the burner, it is not necessary to provide the overflow side wall openings 37 and 38 described for the trough 36 in the event just one of the start measures were to be used.

It is to be appreciated that the vanes as illustrated in the top portion of FIG. 1 and partially in FIG. 2, form right angles to each other to define four quadrants of cooking surface. Three of these quadrants of the cooking area will automatically be shielded from the wind by these vanes whenever the wind is blowing into the fourth quadrant. The vanes further serve as a stand to support the air/fuel plates and vapor generator members and retain them in proper positions and also serve to support a cooking pan on their top edges at a proper distance from the burner flames.

Figure 3:
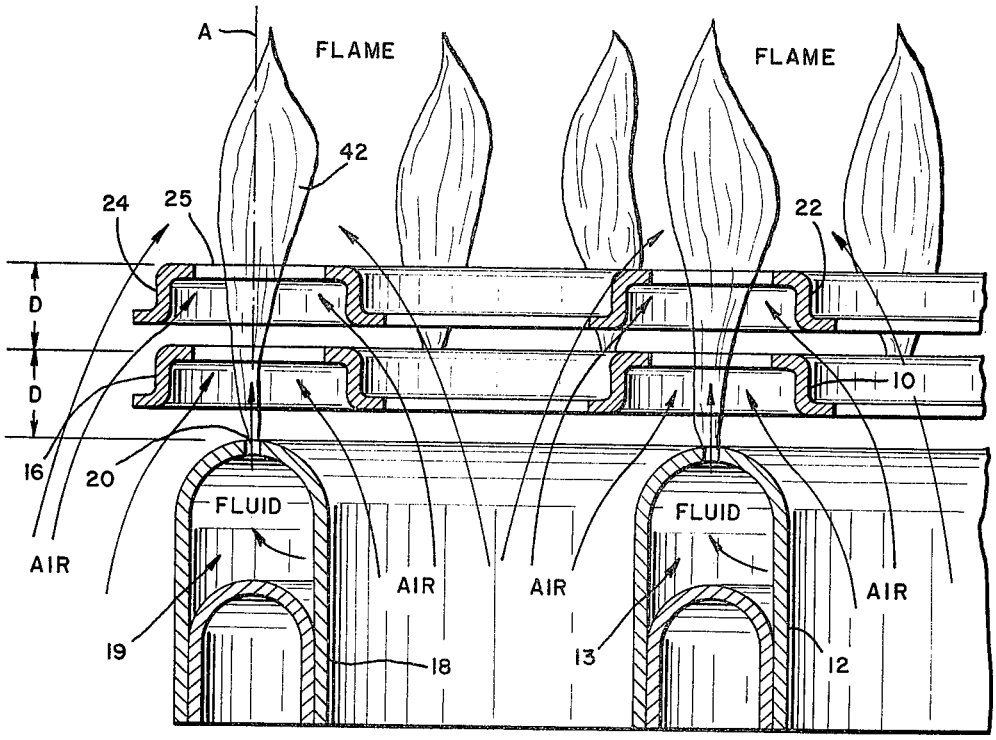
FIG. 3 is a greatly enlarged fragmentary view partly in cross section of a portion of the structure of FIG. 2.

Referring now to FIG. 3, the manner in which combustion takes place will be more fully understood. It will be noted in FIG. 3 that the vertical spacing of the additional inner and outer plates 22 and 24 relative to the first described inner and outer plates 10 and 16 is designated by the letter D which distance is the same as that between the openings in these plates and the outlet fuel ports for the inner and outer vapor generators 12 and 18. Further, the axial alignment of the openings and ports will be evident as indicated by the axis A shown in FIG. 3 for the outer plates 24 and 16 and the vapor generator member 18. This vertical spacing and axial alignment is such that fuel vapor passing upwardly through the ports of the members draws air upwardly around the exterior of the member into the space between the member and plates and up through the openings in the plates to mix with the fuel vapor and provide an efficiently burning or combusting flame 42. In other words, optimum mixing of air and fuel vapor is effected by the geometry described and thus very efficient burning takes place.

Figure 4A:
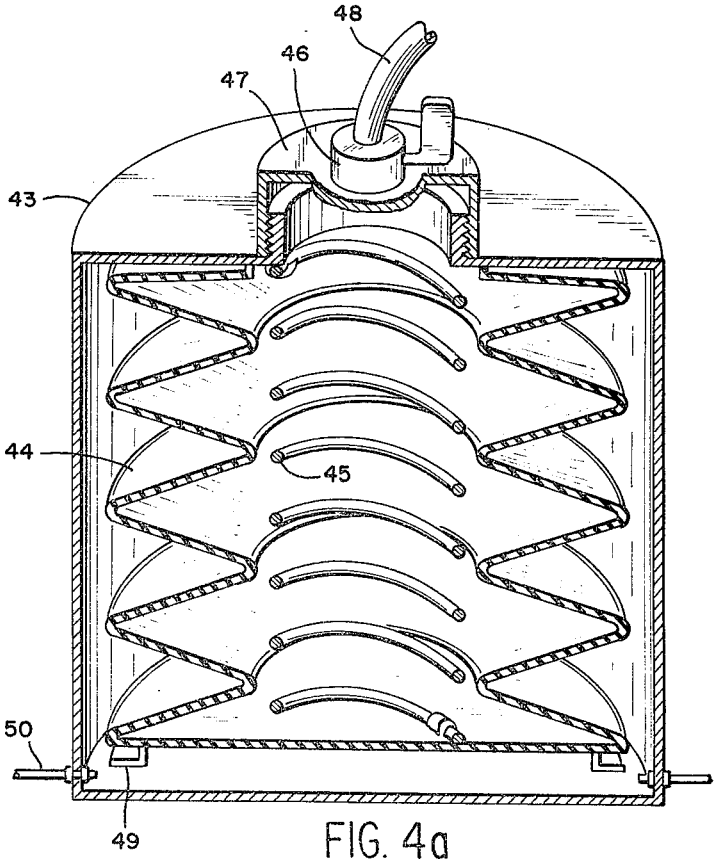
FIG. 4*a* is a perspective cut-away view of a liquid fuel storage means in accord with one embodiment of the invention.

Referring now to FIG. 4*a*, there is shown a first type of liquid fuel storage means for use with the burner described in FIGS. 1 to 3. In this first embodiment, the structure comprises an outer housing 43 within which there is disposed a collapsible bellows-like container 44 incorporating appropriate spring means in the form of a coiled tension spring 45 biasing the container towards its collapsed position. In FIG. 4*a* this collapsed position is when the bottom portion is moved up towards the top.

When the bellows-like container 44 is filled with fuel, the fuel will be biased towards the upper end of the container to pass out through an appropriate valve 46 within an upper end cap 47. A suitable hose or outlet line 48 will then serve as a liquid fuel supply for the burner.

In order to fill the collapsible tank initially, its bottom portion may include appropriate flange areas 49 capable of receiving laterally inwardly urgible pins, such as indicated at 50 to hold the bottom of the bellows like container down against the tension of the spring 45. Alcohol or other equivalent liquid fuel may then be poured into the top by removal of the cap 47, the cap replaced, pins 50 retracted and the valve 46 opened when it is desired to supply fuel. The biasing by the spring 45 tending to collapse the container results in a pressure greater than atmospheric pressures so that fuel can be supplied even though the tank may be at a lower level than the burners.

Figure 4B:
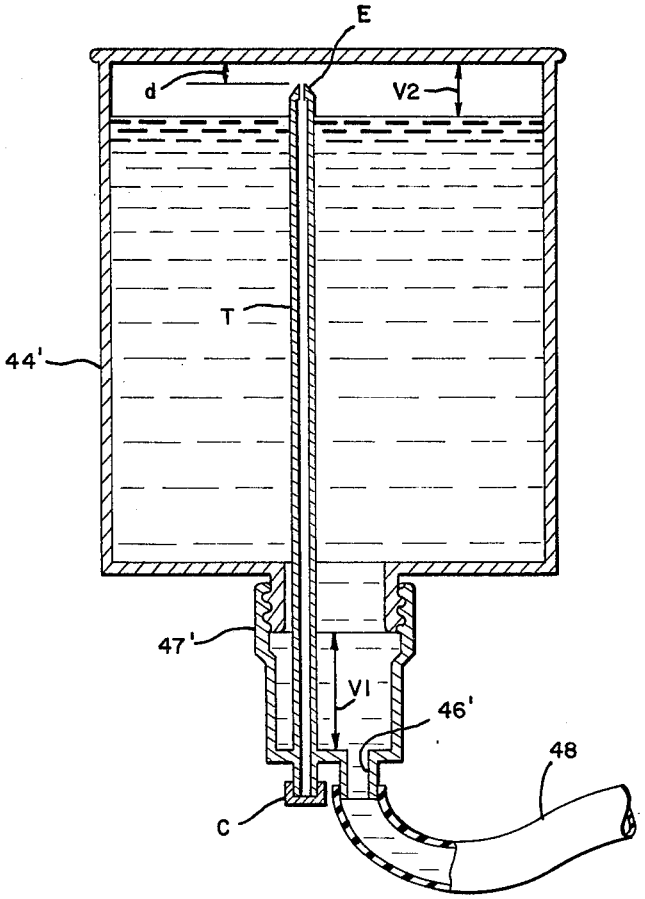
FIG. 4*b* is a cross section of another type of fuel storage means in accord with the invention.

FIG. 4*b* shows a different type of fuel storage container which could be used in place of the container of FIG. 4*a*.

Essentially, the structure of FIG. 4*b*, however, relies on gravity to assure movement of fuel to the burner. In the embodiment of FIG. 4*b*, rather than a bellows-like container as shown in FIG. 4*a* at 44, the container of FIG. 4*b* can comprise a conventional fuel can 44' with a threaded neck for receiving a conventional closure cap. However, in accord with the present invention there is substituted for the conventional closure cap a modified cap structure indicated at 47'. This modified cap structure defines a reservoir Vl of given volume and includes an elongated tube T passing through the cap with one end arranged to extend into the fuel can 44' to terminate short of the bottom by a given distance designated d in FIG. 4*b*. The other end of the tube T extends to the exterior of the cap and is closed off temporarily by a closure C. The modified cap also includes a further opening 46' through which fuel can pass as to an appropriate outlet line which may be the same line 48 as shown in FIG. 4*a* and is thus accordingly designated by the same numeral.

With the foregoing arrangement, the modified cap is substituted for the conventional cap and the can is turned upside down. Fuel will then fall into the reservoir Vl to leave an upper air space in the can as illustrated in FIG. 4*b*. The upper air space has a volume V2 which is equal to the volume Vl. This air space is sufficient that the given distance is such to assure the one end of the tube extends into the air space of the volume V2. With the small cap C at the bottom of the tube T removed, air can enter the air space volume V2 and fuel is thus free to flow by gravity out the opening 46' into the line 48. Closure C prevents fuel from entering the tube when inserting the tube in the can. End E is of smaller inside diameter and has a conical exterior to inhibit fuel from entering when using the can.

Referring now to FIGS. 5 through 10, there is shown a regulator valve for controlling liquid fuel passing to the inner and outer vapor generator members of the burner through the first and additional liquid fuel lines 15 and 21 and also to the start line 41 described in FIGS. 1 and 2. Basically, this regulator valve would be connected between either the fuel storage means shown in FIG. 4*a* or the fuel storage means shown in FIG. 4*b* and the various fuel inlet and start lines.

Figure 5:
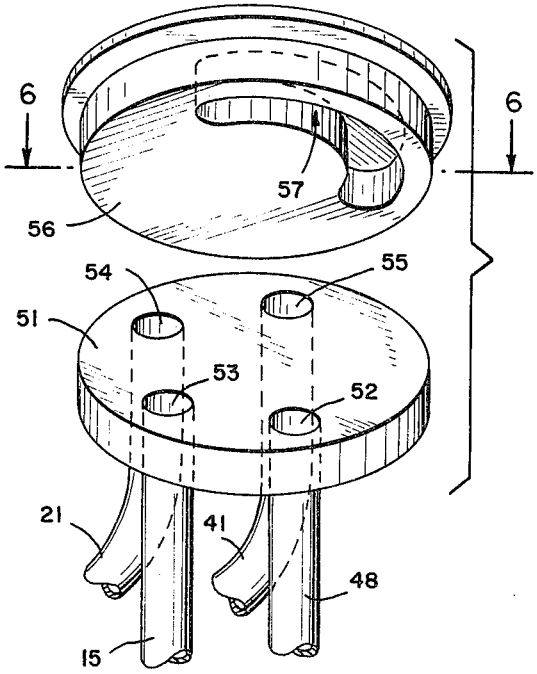
FIG. 5 is a fragmentary exploded view partly schematic in form of a regulator valve constituting part of the combination of the present invention.

Thus, referring first to FIG. 5, the regulator valve takes the form of a base body 51 having a flat top surface and a liquid fuel inlet bore 52 for receiving liquid fuel to be used in the burner. As shown in FIG. 5, the inlet bore 52 connects to the fuel line 48, passing from either one or the other of the fuel storage means illustrated in FIGS. 4*a* and 4*b*.

Also included in the base body 51 are a first outlet bore 53 for connection to the first liquid fuel line 15 shown in FIGS. 1 and 2 and designated by the same numeral in FIG. 5, an additional outlet bore 54 for connection to the additional liquid fuel line 21, the same numeral again being used in FIG. 5 as in FIGS. 1 and 2, and a start bore 55 for connection to the start line 41 passing to the start trough.

It will be noted in FIG. 5 that the unconnected ends of these bores terminate on the referred to top flat surface of the base body 51 all in coplanar relationship.

The regulator valve assembly is completed by the provision of a control body 56 overlying the base body with a flat undersurface arranged to engage in full surface contact the flat top surface of the base body. As shown in the exploded view of FIG. 5, the control body 56 has a channel 57 cut into its under surface. When the control body 56 is assembled on top of the base body 51, in the relative positions illustrated in FIG. 5, this channel will be in communication solely with the liquid fuel inlet bore 52.

Figure 6:
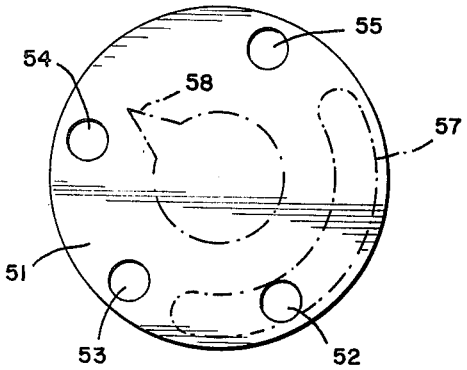
FIGS. 6, 7, 8 and 9 are schematic plan views of various positions for the valve shown in FIG. 5 when in assembled relationship to carry out desired operations in the passing of fuel to the burner of this invention; and, FIG. 10 is a perspective view of the regulator valve of FIG. 5 looking down from the top with the basic components assembled.

The above-described initial positioning of the control body 56 is indicated by the phantom lines in FIG. 6 wherein it will be seen that the channel 57 encompasses only the single inlet bore 52.

In FIG. 6 there is also illustrated in phantom lines on the top of the control body a turning knob with a pointer 58.

Figure 7:
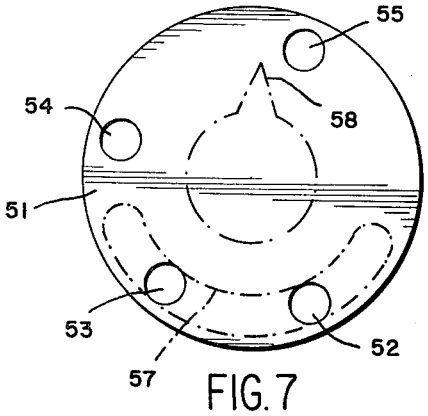

Referring to FIG. 7, when the control body is rotated relative to the base body from its initial position shown in FIG. 6 to a first position shown in FIG. 7, the inlet bore is placed into communication only with the first outlet bore 53 connecting to the fuel line 15. Thus, fuel will pass upwardly through the bore 52, through the channel and thence down through the bore 53 to the inner vapor generator annular member 12 described in FIGS. 1 and 2. Where only low heat is required, it is only necessary to use the inner burner and cooperating air/fuel mixer plate.

Figure 8:
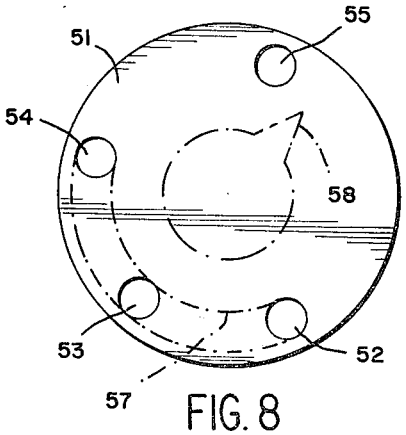

If more flame is desired, the control body can be rotated to a second position to place the inlet fuel bore 52 into communication simultaneously with both the outlet fuel bores 53 and 54 as schematically indicated in FIG. 8. This position would be for high heat and would represent maximum fuel flow to the burner. It should be understood, however, that gradations of movement between the referred to first and second positions in FIGS. 7 and 8 can be made so that only a partial portion of the additional fuel line bore 54 is exposed so that the volume of liquid fuel passing to the outer burner can be regulated in gradual steps. The same, of course, can be effected with respect to the inner burner if simmering conditions are desired. That is, only a portion of the inner burner bore 53 need be exposed by the channel in rotating from the initial position of FIG. 6 to the first position of FIG. 7.

Figure 9:
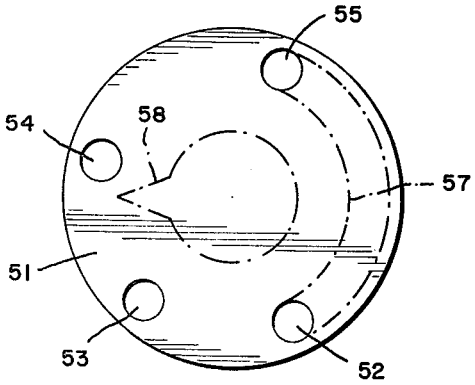

Finally, the knob 58 controlling movement of the control body can be swung to a third position illustrated in FIG. 9 wherein the start bore 55 only is placed into communication with the fuel inlet 52. This position would be utilized to provide fuel to the start box 39 described in FIG. 2, such fuel passing along the start line 41.

In this latter described operation, when a certain amount of liquid fuel has been passed to the start box, all as described heretofore, the wick may be ignited to commence heating of the annular members containing the burning ports and receiving liquid fuel when the knob is now turned to the first or second positions described. Heating by the fire in the start box will vaporize the subsequently applied liquid fuel when the knob is moved from the third position disconnecting the start box fuel line and connecting one or both of the other inlet lines to the fuel inlet bore.

Figure 10:
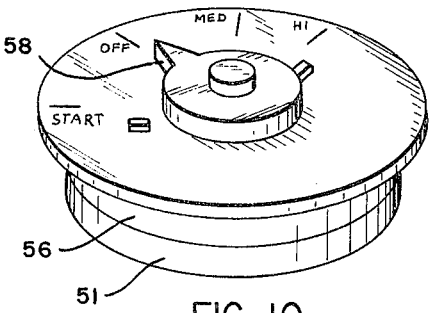

FIG. 10 illustrates the top of the regulator valve wherein the knob and pointer 58 are fully visible with appropriate indexing marks and symbols provided to identify the various regulated positions as described.

As mentioned heretofore, positions between the major divisions can be effected so that a smooth variation in fuel flow is possible with this regulator valve.

From all of the foregoing, it will now be evident that the present invention has provided a greatly improved portable burner apparatus wherein there are not required pressurized gas bottles or special liquid fuel tanks with built in pumps but rather where the burner will function efficiently without major pressurization but only the necessity of supplying fuel either gravity fed or under a slight pressure sufficient to effect fuel flow.

While the plates and members have been shown and described as annular, equivalent heating configurations can be used - square or rectangular or oval construction or even a U shape. Also, more than two air/fuel mixer plates stacked up may be provided. Also, additional vapor generator members and air/fuel mixer plates of increased diameters may be added to increase the cooking ares. Finally, additional cross vanes can be used.

It should be understood accordingly, that the invention should not be thought of as limited to the specific embodiments disclosed merely for illustrative purposes.

We claim:

1. A burner apparatus using vaporized fuel including, in combination:

(a) at least one air/fuel mixer plate lying substantially in a horizontal plane having a plurality of openings facing upwardly;

(b) at least one vapor generator member defining an elongated cavity with a plurality of fuel vapor outlet ports passing through the top wall of the cavity in positions spaced below said openings in said air/fuel mixer plate, respectively; and (c) a first liquid fuel line communicating with an interior portion of said cavity for introducing liquid fuel therein, the vertical spacing between and the dimensioning of said air/fuel mixer plate openings and vapor generator member outlet ports being such that fuel vapor passing upwardly through said ports draws air upwardly around said member into the space between the member and plate and up through said openings in said plate to mix with said fuel vapor and provide an efficiently combusting flame after ignition has taken place.

2. A burner apparatus according to claim 1, in which said air/fuel mixer plate is annular with a hat-shaped cross section, said openings being circular and extending through the top of the annular shape, the side walls of the cross section diverging in a downward direction, said vapor generator member being annular with its ports in axial alignment with said openings and having a convex top surface in cross section defining said top wall of said cavity so that the exterior sides of the cavity and rounded top wall cooperate with the diverging walls of said mixer plate to effect efficient mixing of air and fuel vapor.

3. A burner according to claim 2, in which said air/fuel mixture plate is an inner plate, there being provided an outer annular air/fuel mixer plate of larger diameter than said inner plate coplanar and coaxial with said inner plate, said outer plate having a plurality of circular openings facing upwardly, said vapor generator member being an inner member, there being provided an outer annular vapor generator member of larger diameter than said inner member coplanar and coaxial with said inner member to be in vertically spaced relationship with said outer plate with ports in the outer member in axial alignment with said plurality of openings in said outer plate; and, an additional liquid fuel inlet line passing to the interior cavity of said outer member whereby a larger combustion flame area is provided for said burner apparatus.

4. A burner apparatus according to claim 3, including an additional set of inner and outer air/fuel mixer plates coplanar and coaxial with each other disposed vertically above the first mentioned inner and outer annular air/fuel mixer plates with the openings in the additional plates being in axial alignment respectively with the openings in the first mentioned plates and the vertical spacing between the additional plates and the first mentioned plates corresponding substantially to the vertical spacing between the first mentioned plates and the vapor generator members, said additional plates providing for further mixing of air with fuel vapor.

5. A burner apparatus according to claim 4, including a wind baffling structure in the form of crossed vertical vanes having central cut-out portions and spacer means for receiving and supporting the air-fuel mixer plates and vapor generator members in their respective vertically spaced and coaxial relationships, said vanes shielding burner areas from wind and serving as a stand for supporting a cooking pan at a proper distance from the burner flames as well as functioning as an overall support for the burner.

6. A burner apparatus according to claim 5, including a start trough having a wick disposed beneath the portions of the annular cavities receiving said liquid fuel line and said additional liquid fuel line to said inner and outer members, respectively, the cavity in the inner one of said members having a bottom opening at the entering point of said first fuel line so that any liquid fuel will overflow thorough the bottom opening into the wick in the trough, igniting of said wick in the trough heating the members in the vicinity of fuel entry to vaporize the fuel and ignite the entire burner, thereby providing complete ignition for the burner.

7. A burner according to claim 5, including a start trough having a wick disposed beneath a portion of the annular members, and having a start line for initially carrying liquid fuel when it is desired to start the burner, ignition of said liquid fuel in said start trough heating said members and vaporizing fuel received in the cavities from said liquid fuel line and additional liquid fuel line respectively and completely igniting the entire burner, any further liquid passing through the start line to the start trough being turned off before fuel is passed by way of the liquid fuel inlet lines.

8. A burner apparatus according to claim 5, in which said liquid fuel is alcohol.

9. A burner apparatus according to claim 1 including, in combination, a liquid fuel storage means for providing liquid fuel to said liquid fuel line.

10. A burner apparatus according to claim 9, in which said liquid fuel storage means includes a collapsible bellows-like container having spring means biasing the container towards its collapsed position whereby liquid fuel therein is subject to a pressure above atmospheric pressure so that when placed into communication with said liquid fuel line, fuel will flow even though said container may be at a lower level than said vapor generator member.

11. A burner apparatus according to claim 9, in which said liquid fuel storage means includes a fuel can having a threaded neck for a conventional closure cap; and a modified cap structure for use in place of said conventional closure cap, said modified cap defining a reservoir of given volume and having an elongated tube passing through the cap with one end arranged to extend into said fuel can to terminate short of the bottom by a given distance, and the other end extending to the exterior of the cap, said cap having a further opening through which fuel can pass, whereby when said modified cap is substituted for said conventional cap and said can is turned upside down, fuel will fill said given volume in the cap to leave an upper air space in the can, said given distance being such that said one end of said tube extends into said air space and fuel can thence flow by gravity from said can to pass to said liquid fuel line.

12. A burner apparatus according to claim 11, including a temporary closure for securement to the said other end of said tube extending exterior to said cap to prevent liquid fuel from passing through the tube while inserting the tube into the can, said closure being removed after the said one end of the tube is in communication with said upper air space.

13. A burner apparatus according to claim 7, including a regulator valve for controlling liquid fuel passing to said inner and outer vapor generator members through the first and additional liquid fuel lines respectively, said valve including a base body having a liquid fuel inlet bore for receiving liquid fuel to be used in the burner, a first outlet bore for connection to said first liquid fuel line, an additional outlet bore for connection to said additional liquid fuel line, and a start bore for connection to said start line, the unconnected ends of said bores terminating on a surface of said base body; and a control body for mating engagement with said base body, said control body having a channel in communication with said liquid fuel inlet bore and dimensioned to place said liquid fuel inlet bore into communication only with said first outlet bore when rotated relative to said base body from an initial position to a first position; and into communication with both said first and additional outlet bores simultaneously when rotated to a second position, and into communication only with said start bore when rotated to a third position, fuel being cut-off from all of said bores when said control plate is rotated back to its said initial position.

14. A burner apparatus according to claim 12, in which said one end of said tube has a smaller inside diameter than the inside diameter of the remaining portion of said tube and a conically shaped exterior to thereby inhibit liquid fuel from entering said tube when using said can.

* * * * *